US006658892B2

(12) United States Patent
Fanning et al.

(10) Patent No.: US 6,658,892 B2
(45) Date of Patent: Dec. 9, 2003

(54) PROCESSES AND SYSTEMS FOR LIQUEFYING NATURAL GAS

(75) Inventors: Robert A. Fanning, Highland Village, TX (US); Keenis E. Davis, Houston, TX (US); James E. Kaucher, Katy, TX (US); Rudolph J. Szabados, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 30 days.

(21) Appl. No.: 10/352,457

(22) Filed: Jan. 28, 2003

(65) Prior Publication Data

US 2003/0154739 A1 Aug. 21, 2003

Related U.S. Application Data

(60) Provisional application No. 60/353,494, filed on Jan. 30, 2002.

(51) Int. Cl.[7] ..... F25J 1/00
(52) U.S. Cl. ..... 62/613
(58) Field of Search ..... 62/606, 611, 613

(56) References Cited

U.S. PATENT DOCUMENTS 3,203,191 A 8/1965 French ..... 62/9
3,593,535 A 7/1971 Gaumer, Jr. et al. ..... 62/23
5,916,260 A * 6/1999 Dubar ..... 62/613

FOREIGN PATENT DOCUMENTS

WO WO 97/33131 12/1997

OTHER PUBLICATIONS

A. Avidan, et al., "Large LNG Plants—Optimizing Train Size", Phillips Petroleum Company Website (www.phillips66.com), Jun. 2, 2002, pp. 1–10.

* cited by examiner

*Primary Examiner*—Henry Bennett
*Assistant Examiner*—Malik N. Drake
(74) *Attorney, Agent, or Firm*—Marcy Hoefling

(57) ABSTRACT

Natural gas liquefaction systems are provided wherein dependent trains including only cryogenic heat exchanger systems are serviced by common components in the system such that individual components need not be included in each dependent train for servicing that function. Further, the common components are positioned near the LNG storage tanks which, in turn, are typically located a substantial distance from the trains. This significantly reduces capital costs and allows boil-off gas from LNG storage tanks to be used for cooling in addition to being used as a fuel gas.

17 Claims, 2 Drawing Sheets

PROCESSES AND SYSTEMS FOR LIQUEFYING NATURAL GAS

This application claims the benefit of U.S. Provisional Application No. 60/353,494, filed Jan. 30, 2002.

FIELD OF THE INVENTION

The present invention relates to processes and systems for liquefying natural gas. In one aspect the invention relates to such processes and systems wherein a common separator (i.e. flash tank) and vapor compressor are used by multiple trains within the system to recover vapor both for cooling and for use as a fuel gas.

BACKGROUND OF THE INVENTION

Various terms are defined in the following specification. For convenience, a Glossary of terms is provided herein, immediately preceding the claims.

Large volumes of natural gas (i.e. primarily methane) are located in remote areas of the world. This gas has significant value if it can be economically transported to market. Where gas reserves are located in reasonable proximity to a market and the terrain between the two locations permits, the gas is typically produced and then transported to market through submerged and/or land-based pipelines. However, when gas is produced in locations where laying a pipeline is infeasible or economically prohibitive, other techniques must be used for getting this gas to market.

A commonly used technique for non-pipeline transport of gas involves liquefying the gas at or near the production site and then transporting the liquefied natural gas to market in specially-designed storage tanks aboard transport vessels. The natural gas is cooled and condensed to a liquid state to produce liquefied natural gas at substantially atmospheric pressure and at temperatures of about −162° C. (−260° F.) ("LNG"), thereby significantly increasing the amount of gas which can be stored in a particular storage tank. Once an LNG transport vessel reaches its destination, the LNG is typically off-loaded into other storage tanks from which the LNG can then be revaporized as needed and transported as a gas to end users through pipelines or the like.

As will be understood by those skilled in the art, plants used to liquefy natural gas are typically built in stages as the supply of feed gas, i.e. natural gas, and the quantity of gas contracted for sale, increase. Each stage normally consists of a separate, stand-alone unit, commonly called a train, which, in turn, is comprised of all of the individual components necessary to liquefy a stream of feed gas into LNG and send it on to storage. As used hereinafter, the term "stand-alone train" means a unit comprised of all of the individual components necessary to liquefy a stream of feed gas into LNG and send it on to storage. As the supply of feed gas to the plant exceeds the capacity of one stand-alone train, additional stand-alone trains are installed in the plant, as needed, to handle increasing LNG production.

In typical LNG plants, each stand-alone train includes at least a cryogenic heat exchange system for cooling the gas to a cryogenic temperature, a separator (i.e. a "flash tank"), a "reject gas" heat exchanger, and a fuel gas compressor. As used herein, a "cryogenic temperature" includes any temperature of about −40° C. (−40° F.) and lower. LNG is typically stored at substantially atmospheric pressure and at temperatures of about −162° C. (−260° F.). To reduce the pressure of feed gas during liquefaction, it is typically passed from the cryogenic heat exchanger system across an expansion valve or hydraulic turbine in a stand-alone train (i.e. "flashed") before it is passed into the separator (i.e. the flash tank). As the pressure of the cooled feed gas is reduced to produce LNG at substantially ambient pressure, some of the gas flashes and becomes vapor. LNG is removed from the flash tank and is pumped from its respective stand-alone train on to a storage tank for further handling.

Vapor (i.e. reject gas) is removed from the flash tank and is warmed in the reject gas heat exchanger by exchanging heat with the incoming feed gas and/or the refrigerant(s) used in liquefying the feed gas. The warmed gas is then passed to the fuel gas compressor in the stand-alone train to increase its pressure before the gas is passed on for use as fuel gas within the plant. It can be seen that by recovering the vapor from the flash tank and using it both for cooling within the stand-alone train and ultimately for fuel, the efficiency of the overall liquefaction process is significantly improved.

In typical LNG plants, the stand-alone trains of the liquefying process are all located near each other within the LNG plant area which, in turn, is typically located a significant distance, e.g. several kilometers, from the LNG storage tanks. During storage, heat from the surrounding environment, which inherently leaks into the LNG storage tanks, causes some of the stored LNG to vaporize resulting in "boil-off gas" within the tanks. Additional storage tank boil-off gas is created by: (i) energy input to the LNG by the rundown pumps that provide sufficient pressure to effect LNG transfer from the flash tank to the storage tank; (ii) heat leak through the insulation on the LNG rundown line; (iii) heat leak through the insulation on the LNG loading and recirculation line; and (iv) energy input to the stored LNG by the recirculation pump(s). While this boil-off gas is typically recovered and compressed for use as fuel gas, any attempts to also use this boil-off gas for heat exchange (i.e. cooling) within the gas liquefying process is usually uneconomical due to the distance this gas must travel between a respective storage tank and a respective stand-alone train within the plant area.

It would be desirable if certain functions, which are normally carried out individually in each of the plurality of stand-alone trains, could be combined and carried out jointly in order to reduce the capital costs involved in building and operating an LNG plant. It would also be desirable to be able to utilize the heat-exchange capability of the boil-off gases from LNG storage tanks to improve the overall efficiency of the gas liquefying process.

SUMMARY OF THE INVENTION

The present invention provides natural gas liquefaction systems and processes wherein certain components of the process equipment normally found in each stand-alone train of an LNG plant are eliminated from the trains. As used hereinafter, the term "dependent train" includes any unit in an LNG plant that lacks one or more of the following components: a flash tank, a reject gas heat exchanger, or a fuel gas compressor. A common flash tank, a common reject gas heat exchanger, and a common fuel gas compressor are positioned in the storage area near the LNG storage tanks which, in turn, are located a substantial distance (e.g., at least about 1 kilometer) from the dependent trains in the plant area. Each common component carries out its respective function for all of the dependent trains. An advantage of this invention is that boil-off gas from the storage tanks may be used for cooling in addition to being used as a fuel gas, as is further explained in the following. In some embodiments of this invention, the distance between the LNG storage tanks and the dependent trains may be shorter than 1 kilometer.

More specifically, the present invention relates to a system for liquefying natural gas having a plurality of dependent trains, each of which comprises a cryogenic heat exchanger system. That is, each dependent train receives the feed gas, i.e. natural gas, and cools it to cryogenic temperatures. The cooled feed gas from the plurality of dependent trains is combined and flowed to the storage area where it is flashed through a common flash valve or common hydraulic turbine for pressure reduction and is then flowed into a common flash tank where it separates into LNG and a vapor (i.e. reject gas). As used herein, the term "common flash device" refers to either a common flash valve or a common hydraulic turbine.

The LNG is flowed to a storage tank while the reject gas is flowed through and warmed in a common reject gas heat exchanger. The warmed reject gas is then flowed on to a common fuel gas compressor to increase its pressure before being used as a fuel gas. The boil-off gas from the storage tank(s) is also flowed through the common reject gas heat exchanger where it is warmed before it is combined with the reject gas and fed to the common fuel gas compressor. Both the reject gas and the boil-off gas are heat exchanged with a fluid stream which, in turn, is cooled to a cryogenic temperature and flowed to the common flash tank. The fluid stream may comprise a portion of the feed gas, scrub column overhead gas, and/or some other fluid(s).

It can be seen that the amount of equipment required for liquefying the natural gas is reduced and that the cooling capacity of the boil-off gas from the storage tanks is utilized, thereby increasing the overall efficiency of the process, as compared to a typical LNG plant comprised of only stand-alone trains.

DESCRIPTION OF THE DRAWINGS

The advantages of the present invention will be better understood by referring to the following detailed description and the attached drawings in which.

While the invention will be described in connection with its preferred embodiments, it will be understood that the invention is not limited thereto. On the contrary, the invention is intended to cover all alternatives, modifications, and equivalents which may be included within the spirit and scope of the present disclosure, as defined by the appended claims.

DETAILED DESCRIPTION OF THE INVENTION

Figure 1:
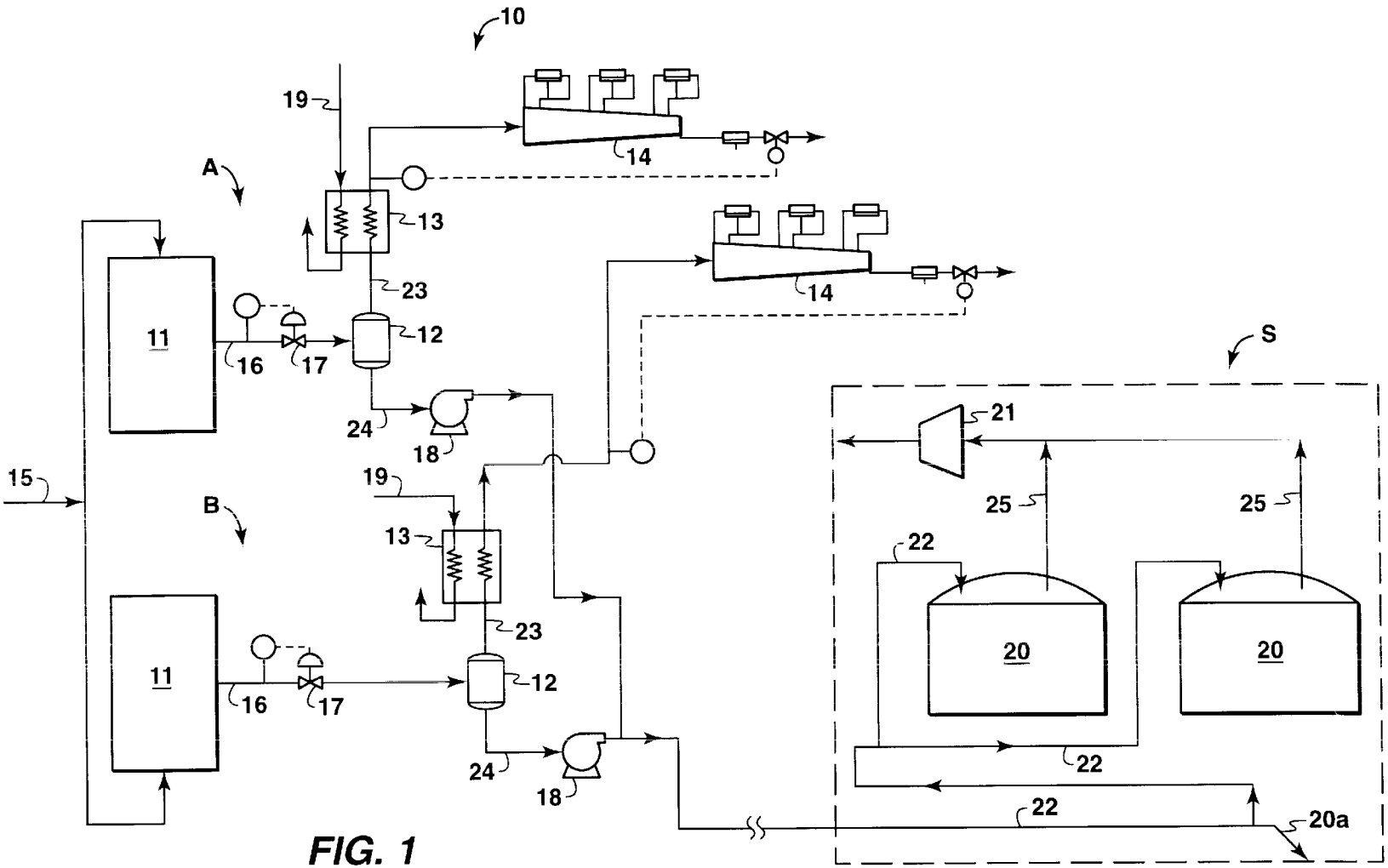
FIG. 1 (PRIOR ART)
FIG. 1 (PRIOR ART) is a schematic, flow diagram of a typical system for liquefying natural gas.

Referring to the drawings, an initial detailed description of a typical LNG plant is provided for comparison to the present invention so that the novelty and advantages of the present invention can be appreciated. FIG. 1 (PRIOR ART) is a schematic illustration of a typical natural gas liquefaction system 10. As will be familiar to those skilled in the art, system 10 is comprised of a plurality of stand-alone trains (two shown, A and B) which are located in an LNG plant. Each stand-alone train receives and liquefies a feed gas (i.e. natural gas) before sending it on to storage tanks 20 which, in turn, are located in storage area S. Each of stand-alone train A and stand-alone train B is substantially identical to each of the other stand-alone trains (not shown) in system 10 and each is comprised of at least a cryogenic heat exchange system 11, a separator (i.e. flash tank 12), a reject gas heat exchanger 13, and a fuel gas compressor 14.

Since the details of the cryogenic heat exchange system 11 of each stand-alone train are well known and since these details, as such, do not form a novel part of the present invention, cryogenic heat exchange system 11 will only be described generally. As known in the art, a typical cryogenic heat exchange system 11 is comprised of two sets of heat exchangers, e.g.(a) a plurality of preliminary heat exchangers (not shown) wherein feed gas from inlet line 15 is initially cooled by a first refrigerant, e.g., propane, and (b) a main cryogenic heat exchanger in which the initially cooled feed gas is cooled to its final cryogenic temperature by a mixed refrigerant (MR), e.g., a mixture of nitrogen, methane, ethane, and propane. The cooled feed gas exits the cryogenic heat exchange system 11 through outlet line 16 and is flashed through flash valve 17 before it flows into flash tank 12. This invention is applicable to other types of cryogenic heat exchange systems, including without limitation those with cascade refrigeration systems that use two or more refrigeration systems. For example, without limiting the scope of this invention, this invention is applicable to cascade refrigeration systems with three refrigeration loops in which the refrigeration from one stage is used to both cool the feed gas and condense the compressed refrigerant in the next stage.

As will be familiar to those skilled in the art, a portion of the cooled feed gas vaporizes as its pressure is reduced across valve or hydraulic turbine 17, such vaporized gas ("reject gas") is separated from the liquid in flash tank 12. The LNG is withdrawn from the bottom of tank 12 through liquid outlet line 24 and is pumped by pump 18 through rundown line 22 to LNG storage tanks 20 and/or onto a transport vessel (not shown) through line 20*a*, as the situation dictates. In this embodiment, the reject gas is withdrawn from the top of flash tank 12 through vapor outlet line 23 and is passed through reject gas heat exchanger 13 where it is warmed by exchanging heat with feed gas and/or some other fluid flowing through line 19. The warmed reject gas is then passed on to fuel gas compressor 14 which boosts the pressure of the reject gas before the reject gas is sent on to be used as a fuel gas. Other means of disposing of the reject gas, including otherwise processing the reject gas, as are familiar to those of skill in the art, are included within the scope of this invention.

Again, it is pointed out that each stand-alone train in an LNG plant is basically a self-contained unit. Each self-contained unit is comprised of substantially the same plurality of separate components, each of which performs the same particular function in its respective stand-alone train. For example, component A1 in stand-alone train A performs the same function as component B1 in stand-alone train B, component A2 in stand-alone train A performs the same function as component B2 in stand-alone train B, etc. Accordingly, each stand-alone train, e.g. A and B, is effectively a separate LNG plant since there is basically no interaction between the stand-alone trains within the LNG plant.

In LNG plants such as described, the storage area S is located a substantial distance, up to several kilometers, from the LNG plant. As heat from the environment inherently leaks into storage tanks 20 and as energy is input to the LNG by one or more pumps, some of the stored LNG vaporizes and becomes "boil-off gas". In typical LNG systems such as shown in FIG. 1, this boil-off gas is removed from the top of the tanks 20 through outlet lines 25 and is passed through a boil-off gas compressor 21 before being sent on for use as a fuel gas. To our knowledge, the cooling capacity of the boil-off gas is not recovered for use in the LNG process in the LNG plant, and due to the distance between the storage area S and trains A and B in the LNG plant, such recovery and use would be uneconomical, if feasible at all.

Figure 2:
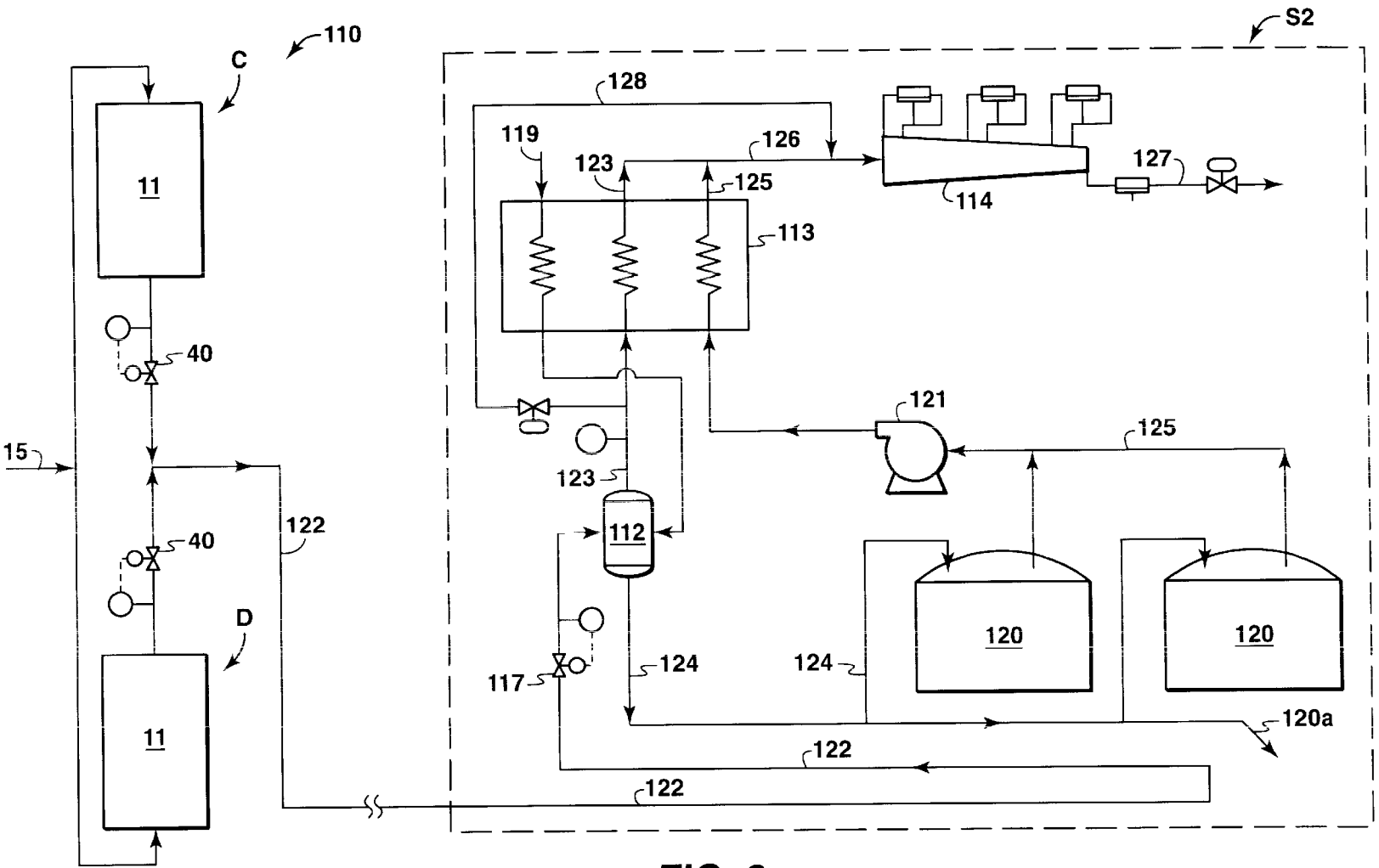
FIG. 2 is a schematic, flow diagram of a system for liquefying natural gas in accordance with the present invention.

Now reference will be made to FIG. 2, which schematically illustrates a natural gas liquefaction system 110 and process of the present invention. System 110 is comprised of a plurality of dependent trains C and D (only two shown) which are installed within the LNG plant illustrated in FIG. 2. Each dependent train C, D is comprised of a cryogenic heat exchange system 11 which, in turn, is basically identical to that described above in reference to FIG. 1. Preferably, each dependent train C, D consists essentially of a cryogenic heat exchange system 11. The present invention differs from the prior art system 10 of FIG. 1 in that a common flash valve or common hydraulic turbine 117, common flash tank 112, common reject gas heat exchanger 113, and a common fuel gas compressor 114 are used to handle the cooled feed gas produced from the respective dependent trains in the LNG plant illustrated in FIG. 2. In some embodiments of this invention, common flash valve or common hydraulic turbine 117 comprises two or more valves or hydraulic turbines that serve the function of one unit. Preferably, all of these common components are located in storage area S2 in relative close proximity of the storage tanks 120, for a purpose described below.

In operation, feed gas supplied through inlet line 15 is cooled to cryogenic temperatures within dependent trains C and D. The flow of feed gas through the cryogenic heat exchangers systems 11 being controlled by respective temperature-control valves 40. The output of cooled feed gas from all of the dependent trains, e. g., C and D, in the LNG plant illustrated in FIG. 2 are combined together in common rundown line 122 which, in turn, carries the combined flow to storage area S2. When the combined cooled feed gas stream reaches storage area S2, it passes through a common flash valve or common hydraulic turbine 117 to reduce the pressure of the cooled feed gas to produce LNG. As the pressure of the cooled feed gas stream is reduced, a portion of the cooled feed gas vaporizes as reject gas and the two-phase cooled feed gas stream is flowed into common flash tank 112 where the reject gas separates from the LNG.

The LNG flows from the bottom of common flash tank 112 through liquid outlet line 124 and into the storage tank(s) 120 in storage area S2 and/or onto a transport vessel (not shown) through line 120*a*, as the situation dictates. The reject gas is taken from the top of flash tank 112 through vapor outlet line 123 and is passed through common reject gas heat exchanger 113 where it is warmed before it flows on to common fuel gas compressor 114. In some embodiments, reject gas taken from the top of flash tank 112 is warm enough (as determined, e.g., by a thermocouple (not shown)) in line 123, to bypass common reject gas heat exchanger 113 and flow directly to common fuel gas compressor 114 through line 128. Further, in the present invention, the boil-off gas from storage tanks 120 is collected in a common line 125 and is compressed slightly in boil-off gas blower 121 before it is passed through common reject gas heat exchanger 113. Although for purposes of illustration the boil-off gas is shown in FIG. 2 going in through the bottom of common reject gas heat exchanger 113, in many embodiments of this invention the boil-off gas will enter common reject gas heat exchanger 113 at an elevation higher than the entry of the reject gas, in order to maximize efficiency. Once it has been warmed in common reject gas heat exchanger 113, the warmed boil-off gas is combined with the warmed reject gas in line 126. The combined stream of warmed reject gas and warmed boil-off gas in line 126 is then fed to common fuel gas compressor 114 to raise the pressure of the combined stream before the compressed gas is passed on through line 127 for use as fuel.

Preferably, common reject gas heat exchanger 113 is a plate fin-type exchanger capable of handling two "cold" streams and one "warm" stream. A fluid stream in warm line 119 is used to warm both the reject gas in cold line 123 and the boil-off gas in cold line 125. The heat exchange within common reject gas heat exchanger 113 causes fluid in line 119 to be cooled to a cryogenic temperature. The cooled fluid stream, in turn, is flashed within common flash tank 112 along with the cooled feed gas from dependent trains C and D. The fluid stream in warm line 119 may comprise a portion of the feed gas, scrub column overhead gas, and/or some other fluid(s).

By removing the flash tank, the reject gas heat exchanger, and the fuel gas compressor from each of the individual trains in the plant area of an LNG process and replacing them with a common flash tank, a common reject gas heat exchanger, and a common fuel gas compressor, all of which, in turn, are located in the storage area away from the dependent trains of the LNG process, significant benefits are realized, some of which are as follows: (1) Less equipment is needed, thereby reducing the capital costs of the LNG plant; (2) A single, spare fuel gas compressor can be installed to back up all of the fuel gas compression required from several different dependent trains; (3) The boil-off gas compressor can be replaced with a less expensive, simple blower; (4) No run-down pump is needed to move the produced LNG to the storage area; (5) More LNG can be economically produced since "cold" from the boil-off gas from the storage tanks can be recovered and used in the feed gas cooling process; and (6) Overall efficiency of the gas liquefaction process is improved.

Many embodiments of the present invention are possible. For example, in an LNG plant comprising a plurality of dependent trains, two or more of the dependent trains may consist essentially of a cryogenic heat exchange system, while other of the dependent trains comprise one or more of the following components: a cryogenic heat exchange system, a flash tank, a reject gas heat exchanger, and/or a fuel gas compressor. The plant may also comprise one or more stand-alone trains. Such a plant would also comprise a common flash tank, a common reject gas heat exchanger, and a common fuel gas compressor. Cooled natural gas from a dependent train consisting essentially of a cryogenic heat exchange system is flowed through the common flash tank. LNG from the common flash tank is flowed to storage while reject gas from the common flash tank is flowed through the common reject gas heat exchanger and then through the common fuel gas compressor. LNG from a dependent train consisting essentially of a cryogenic heat exchange system and a flash tank is flowed to storage while reject gas is flowed through the common reject gas heat exchanger and then through the common fuel gas compressor. Warmed reject gas from a dependent train consisting essentially of a cryogenic heat exchange system, a flash tank, and a reject gas heat exchanger is flowed through the common fuel gas compressor. A common flash tank may comprise two or more flash tanks whose outputs are combined; thus the two or more flash tanks function as a single flash tank. A common reject gas heat exchanger may comprise two or more gas heat exchangers whose outputs are combined; thus the two or more gas heat exchangers function as a single gas heat exchanger. Similarly, the common fuel gas compressor may comprise two or more fuel gas compressors whose outputs are combined; thus the two or more fuel gas compressors function as a single fuel gas compressor. In addition, the common rundown line may comprise two or more rundown lines whose outputs are combined at a common flash valve or common hydraulic turbine; and one or more of the dependent trains may have an individual rundown line and an individual flash valve or hydraulic turbine.

In addition, in one embodiment of this invention, an LNG plant comprises one dependent train and a flash tank positioned in the storage area near the LNG storage tank(s) so that boil-off gas from the storage tank(s) may be used for cooling to produce LNG in the dependent train.

While the present invention has been described in terms of one or more preferred embodiments, it is to be understood that other modifications may be made without departing from the scope of the invention, which is set forth in the claims below.

Glossary of Terms common flash device: a common flash valve or a common hydraulic turbine;

cryogenic temperature: any temperature of about −40° C. (−40° F.) and lower;

dependent train: any unit in an LNG plant that lacks one or more of the following components: a cryogenic heat exchange system, a flash tank, a reject gas heat exchanger, or a fuel gas compressor;

flash tank: a gas/liquid separator;

LNG: liquefied natural gas at substantially atmospheric pressure and at temperatures of about −162° C. (−260° F.);

stand-alone train: a unit in an LNG plant comprised of all of the individual components necessary to liquefy a stream of feed gas into LNG and send it on to storage.

We claim:

1. A natural gas liquefaction system comprising:

(A) two or more dependent trains, each of said dependent trains comprising a cryogenic heat exchanger system for cooling a feed gas to a cryogenic temperature;

(B) a common flash valve or common hydraulic turbine for reducing the pressure of the cooled feed gas to produce liquefied natural gas at substantially atmospheric pressure and a temperature of substantially −162° C. (−260° F.) ("LNG") and a reject gas;

(C) a common flash tank for receiving said LNG and said reject gas from said common flash valve or common hydraulic turbine and wherein said LNG and said reject gas are separated, said common flash tank having a liquid outlet and a vapor outlet;

(D) at least one storage tank for receiving said LNG from said liquid outlet of said common flash tank; and (E) means for disposing of said reject gas received from said vapor outlet of said common flash tank.

2. The natural gas liquefaction system of claim 1 wherein said means for disposing of said reject gas received from said vapor outlet of said common flash tank comprises:

(A) a common reject gas heat exchanger for receiving said reject gas from said vapor outlet of said common flash tank and for warming said reject gas, said common reject gas heat exchanger having a warmed gas outlet; and (B) a common fuel gas compressor having a gas inlet for receiving said warmed reject gas from said warmed gas outlet of said common reject gas heat exchanger and for increasing the pressure of said warmed reject gas.

3. The natural gas liquefaction system of claim 2 wherein said common flash valve or common hydraulic turbine, said common flash tank, said common reject gas heat exchanger, said common fuel gas compressor, and said at least one storage tank are all located at a substantial distance from said two or more dependent trains.

4. The natural gas liquefaction system of claim 3 further comprising means for fluidly connecting said at least one storage tank to said gas inlet of said common fuel gas compressor for allowing flow of boil-off gas from said at least one storage tank to said common fuel gas compressor.

5. The natural gas liquefaction system of claim 4 further comprising a blower positioned between said at least one storage tank and said gas inlet of said common fuel gas compressor for increasing the pressure of said boil-off gas before said boil-off gas passes through said gas inlet of said fuel gas compressor.

6. The natural gas liquefaction system of claim 5 further comprising means for flowing a fluid stream comprising a portion of said feed gas through said common reject gas heat exchanger to warm said reject gas and said boil-off gas and to cool said fluid stream to a cryogenic temperature.

7. The natural gas liquefaction system of claim 6 further comprising means for flowing said cooled fluid stream from said common reject gas heat exchanger to said common flash tank.

8. The natural gas liquefaction system of claim 5 further comprising means for flowing said boil-off gas through said common reject gas heat exchanger before passing said boil-off gas through said fuel gas compressor.

9. The natural gas liquefaction system of claim 1 further comprising at least one stand-alone train comprised of all of the individual components necessary to liquefy a stream of feed gas into LNG and send it on to storage.

10. A process for liquefying natural gas, said process comprising:

(A) cooling a feed gas to a cryogenic temperature in two or more dependent trains, each of said dependent trains comprising a cryogenic heat exchanger system;

(B) flowing said cooled feed gas from said two or more dependent trains to a common flash valve or common hydraulic turbine for reducing the pressure of the cooled feed gas to produce liquefied natural gas at substantially atmospheric pressure and a temperature of substantially −162° C. (−260° F.) ("LNG") and a reject gas;

(C) flowing said LNG and said reject gas to a common flash tank having a liquid outlet and a vapor outlet wherein said LNG and said reject gas are separated;

(D) flowing said LNG from said liquid outlet of said common flash tank to at least one storage tank; and (E) disposing of said reject gas.

11. The process of claim 10 wherein said disposing of said reject gas comprises:

(A) flowing said reject gas from said vapor outlet of said common flash tank through a common reject gas heat exchanger to warm said reject gas;

(B) compressing said warmed reject gas to increase the pressure of said warmed reject gas.

12. The process of claim 11 wherein said warmed reject gas is compressed by passing the warmed reject gas through a common fuel compressor.

13. The process of claim 12 further comprising combining the boil-off gas from said storage tank with said reject gas before said reject gas is flowed to said common fuel gas compressor.

14. The process of claim 13 further comprising flowing said boil-off gas through said common reject gas heat exchanger to warm said boil-off gas before combining said boil-off gas with said reject gas.

15. The process of claim 14 further comprising flowing a fluid stream comprising a portion of said feed gas through said common reject gas heat exchanger to exchange heat with said reject gas and said boil-off gas and thereby be cooled to a cryogenic temperature.

16. The process of claim 15 further comprising flowing said cooled fluid stream from said common reject gas heat exchanger to said common flash tank.

17. The process of claim 10 further comprising reducing the pressure of said cooled feed gas from said two or more dependent trains before flowing said cooled feed gas into said common flash tank.

* * * * *